United States Patent [19]

Murai et al.

[11] 4,364,329

[45] Dec. 21, 1982

[54] ELECTROPHOTOGRAPHIC DEVICE

[75] Inventors: Keiichi Murai, Toride; Naoto Tanaka, Tokyo; Hideyo Kondo, Toride, all of Japan

[73] Assignee: Canon Kabushiki Kaisha, Tokyo, Japan

[21] Appl. No.: 191,026

[22] Filed: Sep. 26, 1980

Related U.S. Application Data

[63] Continuation of Ser. No. 945,115, Sep. 25, 1978, abandoned.

[30] Foreign Application Priority Data

Sep. 30, 1977 [JP] Japan ..... 52-118212

[51] Int. Cl.[3] ..... G03G 15/06

[52] U.S. Cl. ..... 118/652; 51/295; 51/298

[58] Field of Search ..... 51/295, 298; 118/652

[56] References Cited

U.S. PATENT DOCUMENTS

| | | | |
|---|---|---|---|
| 2,712,987 | 7/1955 | Storrs et al. | 51/293 |
| 3,684,466 | 8/1972 | Petrone | 51/298 |
| 3,983,045 | 9/1976 | Jugle et al. | 96/15 |
| 4,078,924 | 3/1978 | Keddie et al. | 118/652 X |

*Primary Examiner*—Bernard D. Pianalto

*Attorney, Agent, or Firm*—Fitzpatrick, Cella, Harper & Scinto

[57] ABSTRACT

An abrasive member for electrophotographic image-holding member comprising an abrasive dispersed in a resin of linear structure.

9 Claims, No Drawings

ELECTROPHOTOGRAPHIC DEVICE

This is a continuation of application Ser. No. 945,115, filed Sept. 25, 1978, now abandoned.

BACKGROUND OF THE INVENTION

1. Field of the Invention

The present invention relates to an abrasive member, and more particularly to an abrasive member for use in abrading the surface of an electrophotographic image-holding member.

2. Description of the Prior Art

An electrostatic image or toner image is formed by various electrophotographic processes. As the image-holding member on which an electrostatic image or toner image is formed, there may be mentioned an electrophotographic photosensitive member and other image-holding members.

The electrophotographic photosensitive members of various constitutions are prepared according to the predetermined characteristics of the members and electrophotographic process to be applied thereto. As typical photosensitive members, there are a member having a photoconductive layer formed on a support and a member provided with an insulating layer on the surface of the former member. These members are used in wide fields. The photosensitive member consisting of a support and photoconductive layer is employed in the image formation based on the most general electrophotographic process which comprises the charging, image exposing and developing steps, and further transferring step if desired. As for the photosensitive member provided with an insulating layer, such layer is formed for the purpose of protecting the photoconductive layer, improving the mechanical strength of the photosensitive member, bettering the dark decay characteristic of the member, or adapting the member to the specified electrophotographic process. Typical photosensitive members having such an insulating layer or examples of the electrophotographic process using the member having an insulating layer are disclosed, for example in U.S. Pat. No. 2,860,048 specification, Japanese Patent Publication Nos. 16429/1966, 15446/1963, 3713/1971, 23910/1967, 24748/1968, 19747/1967 and 4121/1961.

To the electrophotographic photosensitive member, the predetermined electrophotographic process is applied so that an electrostatic image is formed, and then it is visualized by development.

Some of the typical image-holding members other than the electrophotographic photosensitive member will be given below:

(1) Image-holding member used in the electrophotographic process which comprises forming an electrostatic image on a photosensitive member, transferring the image to the image-holding member for the purpose of improving the repeating usability of the photosensitive member, developing the transferred image and transferring the toner image to a recording material. This process is disclosed, for example in Japanese Patent Publication Nos. 7115/1957, 8204/1957 and 1559/1968.

(2) Image-holding member used in the electrophotographic process which comprises forming an electrostatic image on an electrophotographic photosensitive member in a screen form having a large number of fine openings by the predetermined electrophotographic process, applying corona charging treatment to the image-holding member through the electrostatic image to modulate the ion flow from the corona so that the electrostatic image is formed on the above image-holding member, developing such image with a toner, and transferring the toner image to a recording material thereby forming the final image. This process is disclosed, for example in Japanese Patent Publication Nos. 30320/1970 and 5063/1973, and Japanese Patent Laid Open No. 341/1976 as the electrophotographic process in which an electrostatic image corresponding to that formed on the photosensitive member is formed on the image-holding member.

(3) Image-holding member employed in the electrophotographic process which comprises forming a toner image on an electrophotographic photosensitive member, transferring the toner image to the image-holding member without directly transferring it to a recording material, and transferring the toner image from the image-holding member to a recording material followed by fixation. This process is effective, particularly for forming a color image and copying at a high speed. Most of the recording materials are usually flexible, such as for example paper and film. As a result, in the case of transferring cyan, magenta and yellow images directly onto such a recording material, it is difficult to register exactly the positions of the images. On the contrary, if the cyan, magenta and yellow images are transferred onto the image-holding member which can be formed from a hardly deformable material with the positions of the images registered, and if the transferred images are further transferred onto the recording material, a color image in which the positions of the images are more exactly registered can be obtained on the recording member. In addition, it is also effective for high speed copying that a toner image is transferred to a recording material through the image-holding member.

(4) Image-holding member employed in the electrophotographic process which comprises applying electric signal to the multi-stylus electrode to form an electrostatic image corresponding to the electric signal on the image-holding member and developing the image. The image-holding members (1)–(4) do not require a photoconductive layer.

As mentioned above, not only the electrophotographic photosensitive member, but also various members having an insulating property at the surface are employed as the image-holding member on which an electrostatic image or toner image is formed.

The image-holding member requires electric characteristics according to the nature of the electrophotographic process to be applied, and also durability is an important property of the image-holding member. The durability is required in case of repeatedly using the image-holding member. Generally, there are two factors which lower the durability of the image-holding member. One is toner remaining on the member and the other is deterioration in the electric characteristics of the member due to the corona charging.

A toner image formed on an image-holding member is transferred to a recording material such as paper and the like and then fixed to obtain a final image. Usually, the surface of the image-holding member is reused many times. At this time, a new toner image is repeatedly formed on the surface of the image-holding member each time the process for forming the toner image is repeated. Therefore, it is necessary to remove perfectly the toner remaining on the surface of the image-holding member and to clean such surface when the process cycle for the image formation is completed; that is, after the toner image is transferred. As the method of removing the remaining toner, there may be mentioned the method of wiping and scraping the toner off the surface of the image-holding member by a cleaning blade, the method of wiping off the toner by a web-like material rubbing the surface of the member, the method of wiping off the toner by a fur brush and the like, and other methods. However, when the toner remaining on the surface of the image-holding member is removed by those methods, the removing and cleaning efficiency of the methods is lowered as the frequency of repeatedly using the image-holding member is increased, and as a result, even if the surface of the image-holding member is cleaned by the methods, a portion of the toner eventually remains on the surface. The cause of that phenomenon is not yet made clear, but it is considered that since the above mentioned cleaning methods are based on the mechanical dynamic contact between the surface of the image-holding member and the cleaning means, the toner remaining on the surface of the member at the time of cleaning the surface agglomerates or fuses so that such toner adheres firmly to the surface.

If the toner remains on the surfaces of the image-holding member, a ghost image or stripe appears on the formed toner image, or the surface of the image-holding member is damaged so that such member becomes unusable.

Further, when corona discharging is repeated as the charging treatment for forming an electrostatic image on the image-holding member, the electric characteristics in the surface of the member are deteriorated due to the corona ion. This phenomenon is caused by the fact that ionized oxygen, nitrogen, carbonic acid gas, water, ammonia and the like are generated by the energy at the time when the corona ion collides directly with the surface of the image-holding member or by the corona discharging, and they adhere to the surface of the member so that the molecule of the material constituting the surface is broken or oxidized and the surface of the member is deteriorated, or the above mentioned ionized substance adsorbs moisture. As a result, the surface electric resistance of the image-holding member is lowered, and therefore such member cannot retain the electrostatic charges so that the member cannot be used as the desired image-holding member.

For the purpose of reusing the image-holding member to which the remaining toner adheres or whose electric characteristic is deteriorated, it is necessary to recover the initial surface state of the member by abrading the surface to expose the new surface.

In the conventional method for abrading the surface, it is effected in such a manner that a powdered abrasive is directly imparted to the surface, or abrasive is supplied to the surface by dispersing the abrasive in the toner or impregnating the web with the abrasive.

However, in the conventional method, drawbacks are pointed out. For example, the abrasive remains on the surface of the image-holding member. Further, when the abrasive is incorporated into the toner, the image quality of the toner image is deteriorated. Moreover, the abrasive is scattered in the electrophotographic apparatus contaminating the parts of such apparatus. In addition, it is very difficult to supply a abrasive in the constant amount to the surface of the image-holding member.

SUMMARY OF THE INVENTION

It is a primary object of the present invention to provide an abrasive member which is useful for abrading the surface of an image-holding member for electrophotography and effective for resolving the above mentioned drawbacks.

It is another object of the present invention to provide an abrasive member which does not deteriorate the image quality of a toner image.

It is a further object of the present invention to provide an abrasive member which is excellent in durability.

It is still another object of the present invention to provide an abrasive member whose abrasive is not scattered.

According to the present invention, there is provided an abrasive member for an electrophotographic image-holding member comprising an abrasive dispersed in a resin of a linear structure.

DESCRIPTION OF THE PREFERRED EMBODIMENTS

The abrasive member of the present invention is prepared typically by dispersing an abrasive in a solution of resin and coating a layer of the dispersion onto the surface of a support such as web, film, roller, metal foil and the like followed by drying. As another method, resin is melted by heating and then an abrasive may be dispersed in the melted resin. Alternatively, an abrasive may be dispersed in a monomer, substance of low polymerization degree or solution thereof, from which a resin can be formed, and then the resulting dispersion is coated onto a supporting material, and thereafter a resin containing the abrasive dispersed therein may be formed. In a further method, a resin containing an abrasive dispersed therein may be adhered to a support by means of an adhesive.

According to an embodiment of the methods for preparing the abrasive member, an abrasive is sufficiently mixed with and dispersed in resin and then the resulting dispersion is coated and impregnated to a support, for example, a web-like material by the coating method such as spray coating and the like, followed by drying, so that the abrasive member is formed.

The abrasive to be contained in resin may be one that has been employed in the past. It includes calcium carbonate, cerium oxide, magnesium oxide, silicon oxide, magnesium silicate, calcium silicate, aluminum sulfate, calcium sulfate, barium sulfate, magnesium sulfate, boron nitride and the like. Among them, cerium oxide, silicon oxide, calcium carbonate, and barium sulfate are more effective, and particularly, cerium oxide is preferable. The particle diameter of the abrasive contained in resin may usually be 0.01–20 microns, and preferably 0.1–10 microns.

The ratio (by weight) of the abrasive to resin may range from 100:1 to 100:50, and preferably from 100:3 to 100:30.

The resin of linear structure used herein must wear down appropriately. Therefore, its hardness may range from 0.05 H to 3.0 H in the pencil hardness, and preferably from 0.5 H to 2.5 H. As regards the friction resistance between the abrasive member and image-holding member, a smaller resistance is better. The friction coefficient of the linear resin constituting the abrasive member to the image-holding member may range from 0.1 to 2.0, and preferably from 0.5 to 1.6.

As the resin of linear structure used in the present invention, there may be mentioned, for example polyester resin, polyether resin, polycarbonate resin, polyethylene resin, fluorine-containing resin, polyvinyl chloride resin, polyvinyl acetate resin, urethane resin, acrylic resin, epoxy resin and silicone resin. Among them, linear polyestor resin soluble in an organic solvent which is lower in friction resistance and excellent in corona ion resistance is better in terms of protection for the image-holding member. The linear polyester may usually be prepared by the condensation polymerization of an organic dibasic acid compound with a diol compound. Typical dibasic acid is dicarboxylic acid such as for example adipic acid, phthalic acid, maleic acid, succinic acid, and sebacic acid. The diol compound includes ethylene glycol, hexamethylene diol-1,6, bisphenol A, butanediol-1,4, pentanediol-1,5, diethylene glycol, propylene glycol-1,3 and the like. The liner polyester is insoluble in a petroleum type solvent, and therefore it can be used as a resin constituting the abrasive member for treating not only the image-holding member employed in the dry type electrophotographic process, but also the image-holding member used in the wet type process. The molecular weight of the linear polyester may usually range from 5,000 to 50,000 and preferably from 12,000 to 35,000.

Typical constitution of the electrophotographic photosensitive member which is an image-holding member is a laminate of a photo-conductive layer and a support. The support may be formed from optional material, for example a metal plate such as stainless steel, copper, aluminum, tin and the like, paper, sheet and resin film. Further, the support may be omitted if desired.

The photoconductive layer may be formed by the vacuum deposition of an inorganic photoconductive material such as S, Se, pbO, an alloy, intermediate compound and the like. The alloy and intermediate compound may contain any of S, Se, Te, As, Sb and the like. Alternatively, in accordance with the sputtering method, a photoconductive substance having a high melting point, for example ZnO, CdS, CdSe, and $TiO_2$ may be deposited onto a support to form a photoconductive layer. In the case of forming a photoconductive layer by the coating method, there may be used an organic photoconductive material such as polyvinyl carbazole, anthracen, phthalocyanine and the like, those materials sensitized with a dye or Lewis acid, and a mixture of those materials with an insulating binder. In the latter case, a mixture of an inorganic photoconductive material such as ZnO, CdS, $TiO_2$ and PbO etc. and an insulating binder may be preferably employed. Such insulating binder includes various kinds of resins. The thickness of the photoconductive layer may vary depending upon the nature or property of the photoconductive material. It may usually be about 5-100 microns, and preferably about 10-50 microns.

An insulating layer may be formed on the image-holding member. When the insulating layer is formed mainly for the purposes of protecting the image-holding member and improving the durability and dark decay property of the member, the thickness of such layer may be relatively thin. But, when an insulating layer is provided for the purpose of adapting the image-holding member to the specific electrophotographic process, it may be relatively thick. The thickness of the insulating layer may usually be 0.1-100 microns, and preferably 0.1-50 microns. The insulating layer may be formed from various resins, for example, polyethylene, polyester, polypropylene, polystyrene, polyvinyl chloride, polyvinyl acetate, acrylic resin, urethane resin, polycarbonate, silicone resin, fluorine-containing resin and epoxy resin.

It is usually appropriate that the treatment of abrading the image-holding member with the abrasive member is effected after completion of the steps of forming a toner image on the image-holding member, transferring the toner image onto the recording material and cleaning the surface of the image-holding member by a cleaning means. In this case, the abrasive member may be arranged in the electrophotographic apparatus so that the abrading treatment may be effected after the cleaning treatment. The abrasive member may be prepared in forms of plane plate, blade and roll. It may be brought into contact with the surface of the image-holding member, and further, in the case of the abrasive member in a roll form, it may be rotated while it is in contact with the surface of the member.

In the abrasive member of the present invention, the abrasive is dispersed and contained in a resin. When the abrasive member is applied to the surface of the image-holding member, the abrasive in the resin does not remain on the surface of the image-holding member and contaminate the toner during the image formation. Therefore, the abrasive member does not deteriorate the quality of the toner image. Further, the abrasive is not scattered in the inside of the electrophotographic apparatus. Moreover, in order to abrade the surface of the image-holding member with the abrasive member of the present invention, the resin surface of the abrasive member containing the abrasive may be brought into contact with the surface of the image-holding member, and the abrasive material and the image-holding member both may be caused to move relatively. Therefore, the abrading degree can be easily controlled by changing appropriately the contacting power between the abrasive member and the image-holding member and the relative moving speed.

The resin used in the present invention has a linear structure and is capable of providing the abrasive member which is excellent in durability. The function of the abrasive member is effected in such a manner that the surface of the image-holding member is rubbed by the abrasive exposed on the resin surface of the abrasive material. Generally, after the abrasive member is used in the abrading treatment for a certain period of time the abrasive particles taking part in the abrading treatment are worn out, and ultimately the abrading ability of the abrasive member may disappear. However, in the present invention, as the abrasive particles exposed on the resin surface are worn out, the resin is also worn out because the resin of a linear structure is capable of being worn out to an appropriate degree. Therefore, the abrasive particles which are contained in a portion of the resin adjacent to the resin surface are newly exposed on the surface by the wear of the resin as mentioned above. These newly exposed abrasive particles perform the abrading function in place of the abrasive particles which have been worn out. As a result, the abrasive member of the present invention exhibits excellent durability.

Furthermore, the abrasive member of the present invention is capable of protecting the image-holding member and improving the durability of such member in such a manner that a portion of the linear resin is removed from the abrasive member by wear of the abrasive member when used for the abrading treatment so that the removed resin adheres to the surface of the image-holding member.

The invention will be understood more readily by reference to the following examples. However, these examples are intended to illustrate the invention and are not to be construed to limit the scope of the invention.

EXAMPLE 1

A dispersed and dissolved mixture was made using 200 parts by weight of xylene, 100 parts by weight of cerium oxide having a particle diameter of about 4 microns as abrasives and 5 parts by weight of linear polyester resin (trade name: VYLON 200, supplied by Toyobo Co., Ltd.) having a friction coefficient of 1.2 and a pencil hardness of 1.0 H. While the dispersion was sufficiently agitated, it was coated onto a paper web in an amount of 1 g/m$^2$ with respect to the abrasives by an air-spray and dried at 70° C. for 15 minutes to obtain an abrasive member.

As an image-holding member, a photosensitive member was used which has a photoconductive layer having a thickness of 35 microns formed on the surface of an aluminum cylinder and an insulating layer of 30 microns in thickness overlying the photoconductive layer. The photoconductive layer was formed by dispersing 88 parts by weight of cadmium sulfide in 12 parts by weight of a copolymer resin of vinyl chloride and vinyl acetate. The insulating layer was formed from curable silicone resin (trade name: X-12-917, supplied by Shinetsu Kagaku Co., Ltd.).

An electrostatic image was formed on the photosensitive member in such a manner that the primary corona charging of +7 KV was applied to the photosensitive member and image irradiation in a light quantity of 3.0 lux·sec. was carried out simultaneously with the secondary corona charging of AC 7.5 KV and, further, whole surface exposure in a light quantity of 200 lux·sec. was conducted. The electrostatic image was then developed with a toner by the dry type development to form a toner image, which was transferred onto a transfer paper, and the surface of the photosensitive member was cleaned by a rubber blade. Thereafter, the abrasive member was brought into contact with the surface of the photosensitive member and it was advanced at a rate of 0.1 mm per one revolution of the photosensitive member to conduct the abrading treatment.

Even after the electrophotographic process of the above-mentioned steps was repeated a hundred thousand (100,000) times, neither adhering of the toner onto the surface of the photosensitive member nor lowering of the surface electric resistance of the member was observed, and the copied image was found to retain the image quality in the initial stage with sharpness.

On the other hand, the above mentioned electrophotographic process was repeated except that the abrading treatment for the photosensitive member by means of the abrasive member was not conducted. In this case, after the process was repeated about a thousand (1000) times, adhering of the toner onto the photosensitive member surface was observed, and fog in a stripe form was found in the toner image transferred to the transfer paper.

EXAMPLE 2

Abrasive members were prepared by the same procedure as in Example 1 except that silicon oxide, calcium carbonate and barium oxide were substituted for cerium oxide.

The same electrophotographic process as in Example 1 was conducted except that the above-mentioned abrasive members were used. Even after such process was repeated fifty thousand (50,000) times, the toner did not deposit on the photosensitive member surface and a sharp toner image was formed.

EXAMPLE 3

The abrasive member and photosensitive member prepared in Example 1 were used in the following experiment.

An electrophotographic process was applied to the photosensitive member at 35° C. in an atmosphere of 85% relative humidity. The process comprises forming an electrostatic image by the primary corona charging of +7 KV, image exposure (3.0 lux·sec.) simultaneous with the secondary corona charging of AC 7.5 KV and the whole surface exposure (200 lux·sec.), and conducting the abrading treatment in the same manner as in Example 1. An electrostatic image formed after such electrophotographic process was repeated five thousand (5,000) times was developed with a toner by the wet type method and then transferred to a transfer paper. The toner image formed on the paper at that time had a resolution of 8 lines/mm and was a clear image.

On the other hand, when the abrading treatment was not carried out in the above mentioned process, the toner image formed on the transfer paper was blurred and unclear. Therefore, the resolution of the image could not be measured.

EXAMPLE 4

Abrasive members were prepared in the same manner as in Example 1 except that the linear polyester (trade name: VYLON 200) was replaced by the linear polyesters $C_1$–$C_5$ given below.

$C_1$: adipic acid-ethylene glycol condensation polymerization polyester (m.w. about 25,000)

$C_2$: terephthalate acid-ethylene glycol condensation polymerization polyester (m.w. about 38,000)

$C_3$: terephthalic acid-adipic acid-ethylene glycol ternary condensation polymerization polyester (m.w. 20,000)

$C_4$: terephthalate acid-bisphenol A condensation polymerization polyester (m.w. about 7,500)

$C_5$: terephthalic acid-adipic acid-bisphenol A ternary condensation polymerization polyester (m.w. about 30,000)

The same test as in Example 1 was carried out, in which test the abrasive members prepared by the above mentioned manner were used. Even after the electrophotographic process was repeated a hundred thousand (100,000) times, the abrasive particles in the abrasive member were not scattered and did not contaminate the toner. And further, neither deposition of the toner onto the photosensitive member surface nor lowering of the surface electric resistance of such member was observed. As a result, all copied images were of good quality, and the abrasive members were found to be sufficiently useful.

EXAMPLE 5

Abrasive members were obtained in the same manner as in Example 1 except that the linear polyester (trade name: VYLON 200) was replaced by linear resins (1)-(6) given below.

(1) Polyethylene glycol resin (trade name: No. 6000, supplied by Nippen Oils & Fats Co., Ltd.)

(2) Polycarbonate resin (trade name: Panlite, supplied by Teijin Co., Ltd.)

(3) Vinyl chloride-vinyl acetate copolymer resin (trade name: VMCH, supplied by Union Carbide Co., Ltd.)

(4) Polyacrylic resin (trade name: U-polymer, supplied by Unitika Co., Ltd.)

(5) Polyphenylene oxide (trade name: NORYL, supplied by General Electric Co., Ltd.)

(6) Polyamide resin (trade name: Nylon 66, E. I. du Pont de Nemours & Co.)

The same experiment was conducted as in Example 1 except that the abrasive members prepared in the above manner were used. Even after the electrophotographic process was repeated fifty thousand (50,000) times, the abrasive particles were not scattered and did not contaminate the toner. Further, neither adhering of the toner onto the photosensitive member nor lowering of the electric surface resistance of such member was observed. As a result, the obtained copy images were all good in image quality, and the abrasive members were found to be sufficiently useful.

EXAMPLE 6

An electrophotographic process as mentioned below was applied to a photosensitive member having an Se deposition layer of 60 microns in thickness on the surface of an aluminum cylinder at 35° C. in an atmosphere of 85% relative humidity. The electrophotographic process comprises conducting the corona charging so that the surface potential of the photosensitive member may become +800 V, effecting the image exposure in an exposure quantity of 10 lux·sec. to form an electrostatic image and abrading the photosensitive member by the abrasive member of Example 1 in the same manner as in the example. An electrostatic image formed after this process was repeated five thousand (5,000) times and was developed with a toner by the wet type method and then transferred onto a transfer paper. The toner image formed on the paper was found to exhibit a resolution of 8 lines/mm and to be a sharp image.

In the above experiment, when the abrading treatment by the abrasive member was not conducted, the toner image formed on the transfer paper was blurred and unclear, and its resolution could not be measured.

REFERENCE EXAMPLE

The same test procedure as in Example 1 was conducted except for the use of abrasive members which were prepared by using non-linear curable resins (1)–(4) mentioned below in place of the linear polyester.

(1) Photocurable polyester resin (trade name: UV-102, supplied by Cashew Co., Ltd.)

(2) Photocurable epoxy resin (trade name: W-4, Dainichiseika Color & Chemicals Mfg. Co., Ltd.)

(3) Thermosetting silicone resin (trade name: S-114, Teijin Co., Ltd.)

(4) Thermosetting acrylic resin (trade name: Pulslac, Chugoku Marine Paints Co., Ltd.)

As a result of the above test, after the electrophotographic process was repeated five thousand (5,000) times, it was found that the abrading ability of the abrasive members disappeared. Further, in the repetition of the electrophotographic process thereafter, the toner deposited onto the photosensitive member and the obtained image was blurred.

In addition, the abrasive members used in the above test were prepared by dispersing the abrasive (cerium oxide) in a solution of each uncured resin as mentioned above, then coating and drying the dispersion followed by curing the resin. The pencil hardness of the resins used for that purpose ranges from about 4 H to 6 H and the friction coefficient ranges from 2.8 to 3.5.

We claim:

1. An electrophotographic device comprising:

an image-holding member for forming an electrostatic image thereon;

means for forming a toner image on said image-holding member;

means for transferring the toner image from said image-holding member to a recording material;

means for cleaning the surface of said image-holding member to remove the remaining toner thereon after the transfer of the toner image; and means for abrading the surface of said image-holding member to prevent the buildup of excess toner thereon after the cleaning of the image-holding member, said means including an abrasive member comprising a support and a layer overlying the support, said layer being formed of a resin having a linear structure and abrasive particles dispersed therein.

2. An electrophotographic device according to claim 1, wherein said image-holding member is a photosensitive member having a photoconductive layer.

3. An electrophotographic device according to claim 1, wherein said resin has a pencil hardness ranging from 0.05 H to 3.0 H.

4. An electrophotographic device according to claim 1, wherein said resin has a friction coefficient ranging from 0.1 to 2.0 with respect to said image-holding member.

5. An electrophotographic device according to claim 1, wherein said abrasive is selected from calcium carbonate, cerium oxide, magnesium oxide, silicon oxide, magnesium silicate, calcium silicate, aluminum sulfate, calcium sulfate, barium sulfate, magnesium sulfate and boron nitrate.

6. An electrophotographic device according to claim 1, wherein said abrasive is dispersed in a linear polyester resin.

7. An electrophotographic device according to claim 6, wherein said linear polyester resin has a molecular weight in the range from 5,000 to 50,000.

8. An electrophotographic device according to claim 1, wherein the weight ratio of said abrasive to said resin is from 100:1 to 100:50.

9. An electrophotographic device according to claim 1, wherein said abrasive has a particular diameter from 0.01–20 microns.

* * * * *